US005425105A

United States Patent [19]

Lo et al.

[11] Patent Number: 5,425,105

[45] Date of Patent: Jun. 13, 1995

[54] MULTIPLE ADAPTIVE FILTER ACTIVE NOISE CANCELLER

[75] Inventors: Allen K. Lo, Diamond Bar; Paul L. Feintuch, Covina, both of Calif.

[73] Assignee: Hughes Aircraft Company, Los Angeles, Calif.

[21] Appl. No.: 53,728

[22] Filed: Apr. 27, 1993

[51] Int. Cl.[6] ..... G10K 11/16

[52] U.S. Cl. ..... 381/71

[58] Field of Search ..... 381/71

[56] References Cited

U.S. PATENT DOCUMENTS 4,689,821 8/1987 Salikuddin et al. ..... 381/71

OTHER PUBLICATIONS

"Hear No Evil" *Popular Science* Apr. 1992, p. 84.

*Primary Examiner*—Forester W. Isen

*Attorney, Agent, or Firm*—W. K. Denson-Low

[57] ABSTRACT

An active adaptive noise canceller that does not require a training mode and operates over an extended noise bandwidth. The canceller partitions the noise bandwidth into frequency sub-bands, and multiple adaptive filter channels are employed, one for each sub-band, to cancel noise energy in the respective sub-bands. Each channel includes bandpass filters to restrict the channel to operation over only the particular sub-band, and delays are inserted in the operation of the filter weight updating. Because each channel is stable over its sub-band, the canceller operates over the extended noise bandwidth of all the sub-bands.

36 Claims, 5 Drawing Sheets

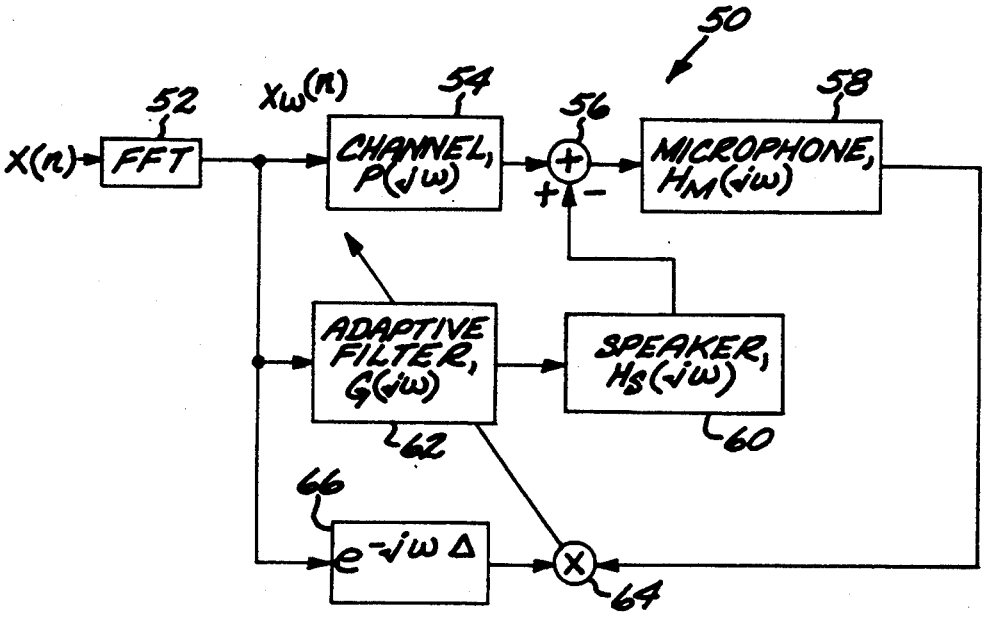
FIG. 1 (PRIOR ART)
FIG. 2 (PRIOR ART)
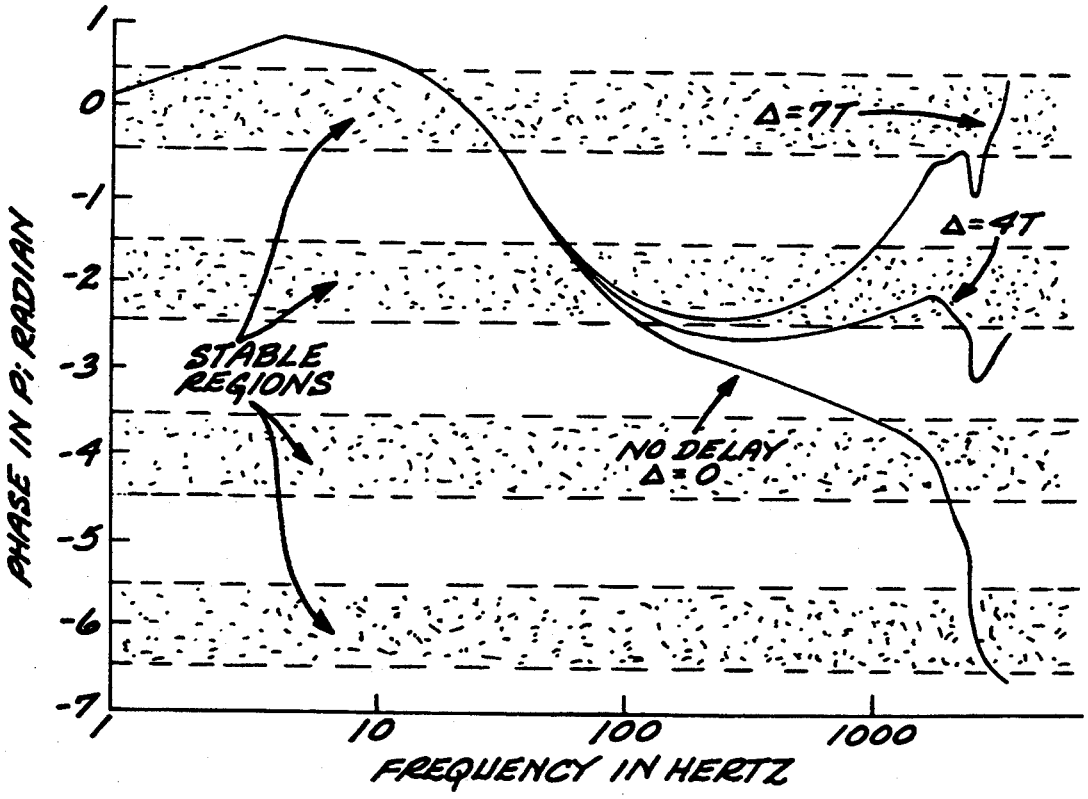

100
ACOUSTIC PATH
ELECTRICAL PATH
NOISE SOURCE
90
PRIMARY
$H_{CHANNEL}$
92
ERROR
+
−
94
SENSOR
110
$H_{MIC}$
154
$H_{SPEAKER}$
152
150
+
+
ANC SIGNAL PROCESSING WITH BANDPASS FILTER #1
120
ANC SIGNAL PROCESSING WITH BANDPASS FILTER #2
140

MULTIPLE ADAPTIVE FILTER ACTIVE NOISE CANCELLER

BACKGROUND OF THE INVENTION

The present invention relates to active noise cancellation systems, and more particularly to systems having extended frequency stability regions so as to permit the suppression of broader bandwidth disturbances.

The objective in active noise cancellation is to generate a waveform that inverts a nuisance noise source and suppresses it at selected points in space. In active noise cancelling, a waveform is generated for subtraction, and the subtraction is performed acoustically, rather than electrically.

In a basic active noise cancellation system, a noise source is measured with a local sensor such as an accelerometer or microphone. The noise propagates acoustically over an acoustic channel to a point in space where noise suppression is desired, and at which is placed another microphone. The objective is to remove the acoustic energy components due to the noise source. The measured noise waveform from the local sensor is input to an adaptive filter, the output of which drives a speaker. The second microphone output at the point to be quieted serves as the error waveform for updating the adaptive filter. The adaptive filter changes its weights as it iterates in time to produce a speaker output that at the microphone looks as much as possible (in the minimum mean squared error sense) like the inverse of the noise at that point in space. Thus, in driving the error waveform to have minimum power, the adaptive filter removes the noise by driving the speaker to generate inverted noise in order to suppress it.

Many previous active noise cancelers use the filtered-X LMS algorithm, which requires a training mode. The function of the training mode is to learn the transfer functions of the speaker and microphones used in the system so that compensation filters can be inserted in the feed-back loop of the LMS algorithm to keep it stable. As the physical situation changes, the training mode must be re-initiated. For example, in an automobile application to suppress noise within a passenger compartment, the training mode may need to be performed again every time a window is opened, or another passenger enters the compartment, or when the automobile heats up during the day. The training mode can be quite objectionable to passengers in the vehicle.

Commonly assigned U.S. Pat. No. 5,117,401, the entire contents of which are incorporated herein by this reference, describes an active adaptive noise canceller which does not require a training mode. The insertion of a time delay in the computation of the updated weights modifies the frequency stability regions of the canceller. Hence, the canceller provides a mechanism through which the adaptive noise cancellation can be easily adapted to suit any application at hand by simply adjusting the time delay value to acquire the desired frequency stability regions. This approach however, has a limitation in that the insertion of delay provides very limited control over the bandwidth of the frequency stability region.

It is therefore an object of the present invention to provide an active noise cancellation system employing a LMS filter algorithm with extended frequency stability regions to permit the suppression of broader bandwidth disturbances.

SUMMARY OF THE INVENTION

In accordance with the invention, an active noise canceller is described, wherein the noise bandwidth over which suppression is to take place is partitioned into frequency sub-bands, and multiple adaptive filter channels using different delays to achieve stability in the respective sub-bands are employed. Each channel includes band-pass filters to restrict the channel to operation over only the particular frequency sub-band, and delay is inserted in the operation of the filter weight updating. Because each channel is stable over its frequency sub-band, the canceller operates over the extended noise bandwidth formed by all the sub-bands.

In an exemplary embodiment, the canceller suppresses noise signals from a noise source, and includes a noise sensor for generating noise sensor signals representative of the noise signals, an acoustic sensor, and acoustic output device. First and second channels are responsive to the noise sensor signals and the acoustic sensor signals, and adaptive filters generate respective channel output signals which are combined to drive the acoustic output device. Each channel includes respective bandpass filters which restrict the operation of the channel to a particular frequency sub-band, by filtering the noise sensor signal and the acoustic sensor signal. Each channel further includes delay means for delaying the operation of the filter weight updating.

BRIEF DESCRIPTION OF THE DRAWING

These and other features and advantages of the present invention will become more apparent from the following detailed description of an exemplary embodiment thereof, as illustrated in the accompanying drawings, in which:

FIG. 1 illustrates, in the frequency domain, an adaptive noise canceller (ANC) employing a delay in the weight updating to remove the necessity for a training mode.

FIG. 2 illustrates, for the canceller of FIG. 1, the phase response of the product of the speaker-microphone and time delay transfer functions.

DETAILED DESCRIPTION OF THE PREFERRED EMBODIMENT

Figure 3:
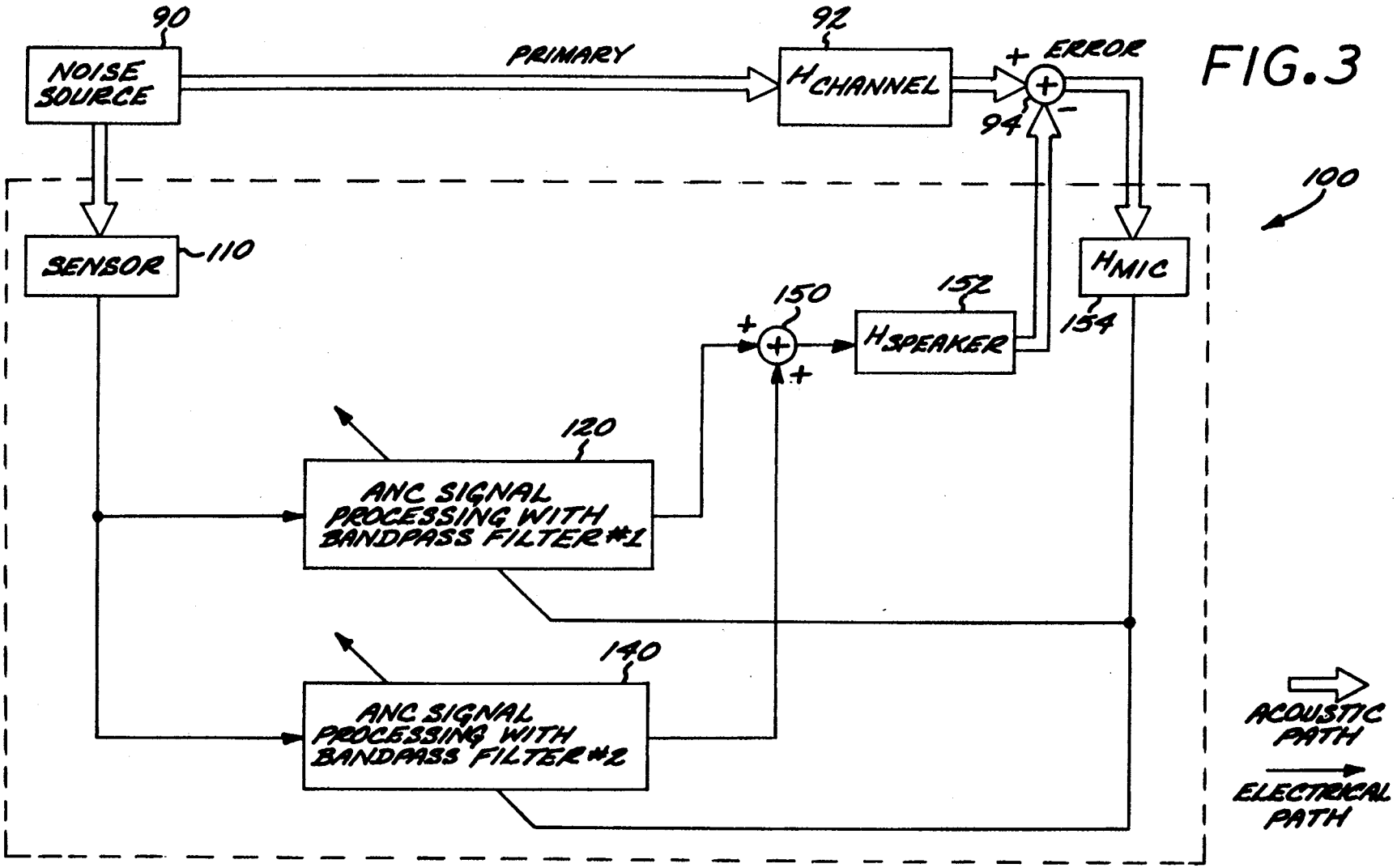
FIG. 3 is a simplified schematic block diagram of an adaptive noise cancellation system with parallel ANC processing channels to extend the frequency stability regions.

FIG. 1 depicts the frequency domain analog, for explanatory purposes, of an adaptive noise canceller (ANC) 50, more fully described in U.S. Pat. No. 5,117,401, which does not require a training mode. The frequency domain analog is discussed to illustrate the frequency stability regions of this canceller. The noise x(n) from a noise source is passed through a fast Fourier transform (FFT) function, and the resulting FFT components $x_\omega(n)$ are passed through the acoustic channel, represented as block 54, with a channel transfer function $P(j\omega)$. The ANC system 50 includes a microphone 58 with its transfer function $H_M(j\omega)$ and a speaker 60 with its transfer function $H_S(j\omega)$. The acoustic channel 54 inherently performs the combining function 56 of adding the channel response to the negative of the speaker excitation. The microphone 58 responds to the combined signal from combiner 56. The Fourier components are also passed through an adaptive LMS filter 62 with transfer function $G(j\omega)$. The filter weights are updated by the microphone responses, delayed by a time delay $\Delta$ (66).

It can be shown that the adaptive filter 62 of the ANC system 50 of FIG. 1 is stable in the frequency regions in which the real part of the product of the microphone-speaker and the delay line transfer functions is positive, i.e., $\text{Real}\{\exp(j\omega\Delta)H_m(j\omega)H_s(j\omega)\}>0$. A corollary to this inequality is that the phase of $\{\exp(j\omega\Delta))H_m(j\omega)H_s(j\omega)\}$ must lie inside $(2n\pi-\pi/2$, $2n\pi+\pi/2)$, $n=1, 2, \ldots$, i.e., the right side of the complex plane. The phase of $\{\exp(j\omega\Delta)H_m(j\omega)\ H_s(j\omega)\}$ is plotted in FIG. 2, where $H_m(j\omega)$ and $H_s(j\omega)$ are modelled by a Tchebychev and a Butterworth filter, respectively. In this example for the "no delay" case, i.e., $\Delta=0$, the stability regions of the adaptive filter can be found by locating the phase of $\{\exp(j\omega\Delta)H_m(j\omega)H_s(j\omega)\}$ within the stippled bands of FIG. 2, and they fall approximately from 1 to 2 Hz, 17 to 42 Hz, 70 to 170 Hz, 1500 to 2900 Hz, and 3400 to 5000 Hz. For a sampling frequency of 10,000 Hz, the insertion of a 7 sample delay provides upward bending of the phase curve to the speaker-microphone phase response function so that the stability regions now have changed to approximately 1 to 2 Hz, 17 to 42 Hz, 70 to 1400 Hz and 3000 to 5000 Hz.

"Frequency stability region" in the context of this ANC system means that the adaptive filter is stable when operated to suppress disturbing signals within this frequency range. Conversely, the adaptive filter cannot be kept stable absolutely when it is excited by signals that fall outside of this region.

In the example shown in FIG. 2, the insertion of a 7 sample delay, based on a sampling frequency of 10,000 Hz, has extended the frequency stability region to from 70 to 1400 Hz, as compared to the region 70 to 170 Hz with no delay. However, further expansion of the frequency stability region beyond the 1400 Hz is not achievable with the use of a single insertion of delay. This is because a bulk delay has a phase response of a straight line with its slope proportional to the delay value. Consequently, there is a limited range of frequencies for which a single value of the bulk delay can stabilize the composite phase response of the system. On the other hand, if the disturbance signal is partitioned, in accordance with this invention, into two (or more) separate frequency bands prior to input to two adaptive filters which are structured to operate independently in parallel with two different delays, it is then possible to suppress a disturbing signal which has frequency components higher than 1400 Hz.

FIG. 3 depicts a block diagram of an ANC system 100 implemented in the time domain and embodying this multiple adaptive filter scheme. ANC system 100 operates to cancel noise acoustic energy generated by a noise source 90, which propagates over an acoustic channel indicated by block 92, by generating acoustic cancelling energy with a speaker 152. The acoustic channel inherently subtracts the acoustic energy emitted by ANC speaker 152 from the noise energy emitted by source 90. The system 100 includes a microphone 154 which detects the error, i.e., the residual acoustic energy, and feeds back an electrical error signal to the ANC signal processing channels 120 and 140. The system 100 further includes a sensor 110 for sensing the noise energy emitted by the source 90. The sensor output signal is fed to the channels 120 and 140 which operate over different portions of the frequency band. The outputs of the respective channels 120 and 140 are summed at node 150 to cancel over a larger bandwidth than either channel could separately, and the combined output drives the speaker 152.

The ANC system 100 of FIG. 3 effectively partitions the disturbance signal band into two separate frequency bands, with one adaptive filter operating in one band, and the other adaptive filter operating in the second band. This partition is achieved with the use of two pairs of matching bandpass filters at the inputs to the adaptive filters and the output of the error microphone. These pairs of bandpass filters should have pass band characteristics that are consistent with their respective frequency stability regions so that the adaptive filters are not excited by out-of-band energy thereby resulting in filter instability.

Figure 4:
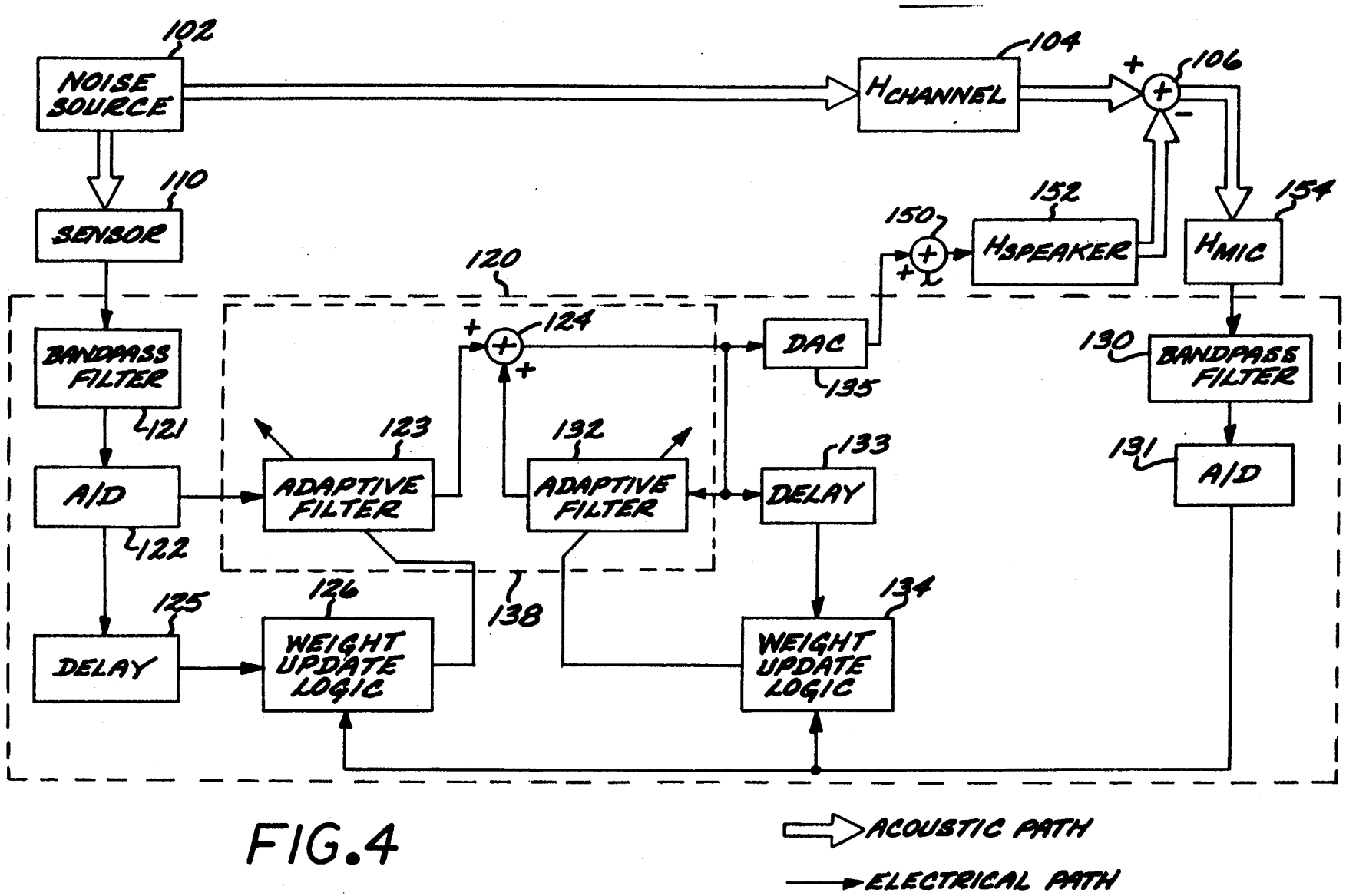
FIG. 4 is a simplified schematic block diagram of an ANC processing channel comprising the system of FIG. 3.

FIG. 4 illustrates the ANC signal processing channel 120 in further detail. Channel 140 is similar to channel 120, except that the bandpass filters are tuned to a different frequency band, and accordingly need not be described further in detail. Channel 120 includes a pair of bandpass filters 121 and 130. Filter 121 filters the signal from the noise source sensor 110, and filter 130 filters the signal from the error microphone 154. The filters are constructed to have identical pass bands. The filtered signals are digitized by respective A/D convertors 122 and 131. The digitized signal from convertor 122 drives a recursive adaptive LMS filter 138 which employs the LMS algorithm. The filter 138 comprises a feed-forward adaptive filter 123, a feed-backward adaptive filter 132, and a summing node 124, and is updated in the manner described in "An Adaptive Recursive LMS Filter," by P. L. Feintuch, *IEEE Proceedings*, Vol. 64, No. 11, November 1976. The signal from convertor 122 is also delayed by delay 125, and the delayed digitized signal is an input to the weight update logic 126. The digitized signal from convertor 131 is provided as an input to the weight update logic 126 and to the weight update logic 134.

The weight update logic 123 serves to provide the updated weights for the adaptive LMS filter 123. The filter 123 output is summed at summing node 124 with the output from adaptive filter 132 in a recursive relationship, with the summed signal driving the filter 132. The summed signal also is delayed by delay 133, and then provided to the weight update logic 134 as another input. The digital summed signal is also converted into an analog signal by digital-to-analog convertor (DAC) 135. The converted analog signal is in turn summed with the outputs from the other channel 140 at combiner 150, and the combined signal from both channels drives the cancelling speaker 152.

The channel 120 operates in the same manner as the recursive noise canceller system 40 shown in FIG. 4 of U.S. Pat. No. 5,117,401, except that the system 40 does not employ bandpass filters as in channel 120.

For the exemplary embodiment in FIGS. 3 and 4, consider the case where the bandwidth of the disturbance is from 70 to 3200 Hz. An ANC system comprising one adaptive filter will not be capable of handling the bandwidth since there is no single delay value that can provide sufficient phase compensation over a bandwidth of that size. Using the invention described herein, it is now possible to do so. For this example, bandpass filters 121 and 130 have bandwidth of 70 to 1300 Hz. The corresponding bandpass filters for channel 140 have a bandwidth of 1300 to 3200 Hz. Delay circuits 125 and 133 introduce a delay equal to 7 samples (at a sample rate of 10,000 Hz), while the corresponding delay circuits for channel 140 introduces a delay equivalent to 4 samples (see FIG. 2 for the phase response of these delay values). This will provide active noise suppression over the entire 70 to 3200 Hz band without requiring a training mode. This invention can be further generalized to have a structure which contains multiple parallel adaptive filters.

Figure 5:
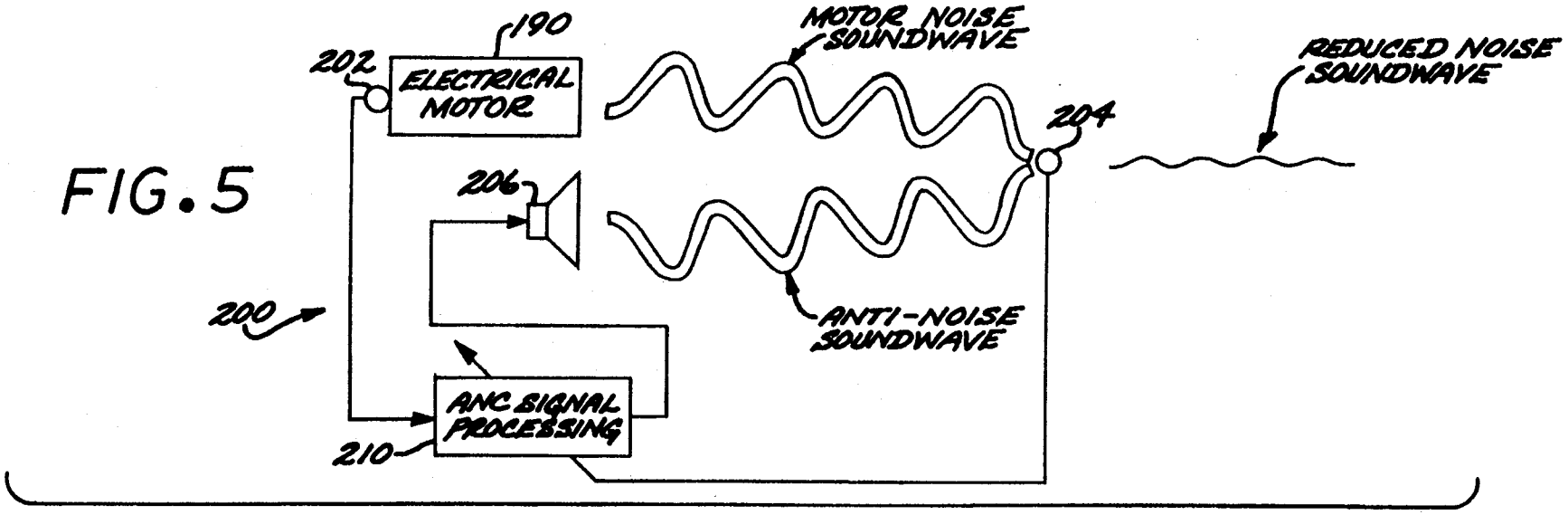
FIGS. 5–7 illustrate ANC systems for reducing electrical motor/engine noise, reducing engine noise and enhancing audio program deliveries, respectively, in accordance with the invention.

FIG. 5 illustrates a first exemplary application for an ANC system 200 in accordance with the invention. In this application the system 200 is used to cancel noise from a noise source such as an electric motor or an engine 190. Here, a reference sensor 202 is used to measure the noise signals from the noise source 190. The error microphone 204 is placed at the point in space at which the noise signal is to be cancelled. A speaker 206 is placed adjacent the noise source 190, and is connected to the ANC signal processing circuit 210 which drives the speaker with appropriate drive signals so as to produce cancelling signals which cancel the noise from the noise source 190.

The ANC circuit 210 comprises the first and second ANC channels 120 and 140 and adder 150 of the system shown in FIG. 3. Circuit 210 receives input signals from the reference sensor 202 and the error microphone 204.

Figure 6:
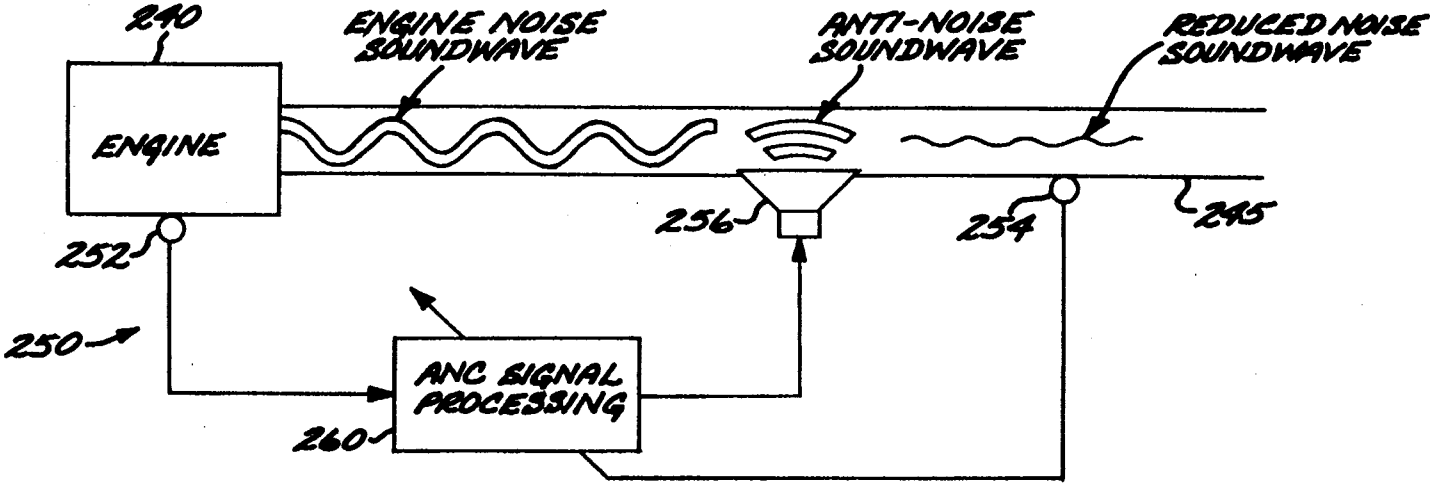

FIG. 6 shows a second exemplary application for an ANC system 250 in accordance with the invention, used to reduce the engine noise emitted from an automobile engine 240 via the automobile tailpipe 245. In this system, the reference sensor 252 is placed adjacent the engine, and the error microphone is place adjacent the tailpipe 245 near the tailpipe opening. The speaker 256 is located in an opening in the tailpipe between the engine and the error microphone 254, for emitting an anti-noise soundwave to cancel engine noise. The speaker 256 is driven by the ANC signal processing circuit 260. The circuit 260 receives input signals from the reference sensor 252 and the error microphone 254. The ANC circuit 260 comprises the first and second ANC channels 120 and 140 and adder 150 of the system of FIG. 3.

Figure 7:
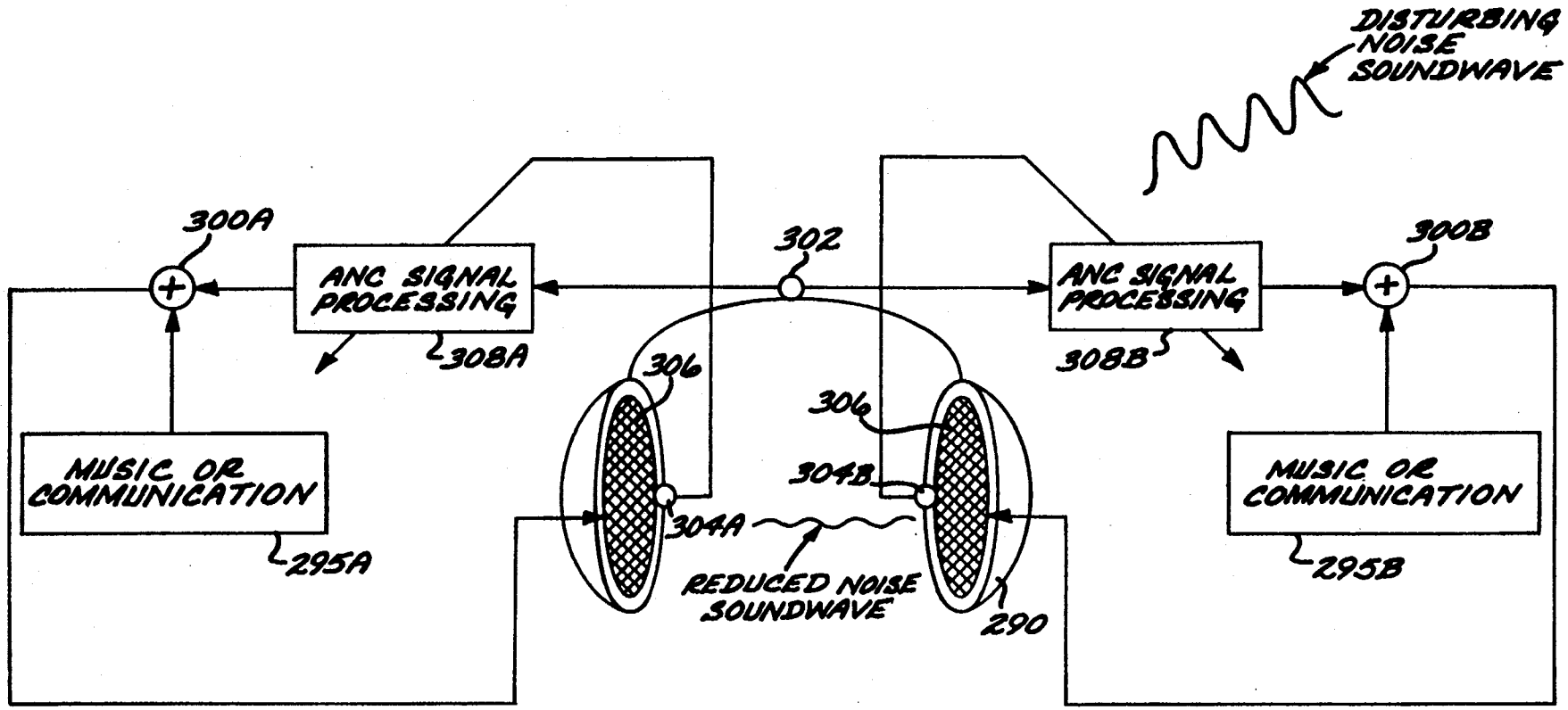

FIG. 7 shows a third exemplary application for an ANC system 300 in accordance with the invention, used in a stereo headphone set 290 to cancel a disturbing noise soundwave. In this system, the headphone speakers 306 are used to produce the reduced noise soundwave. A reference microphone 302 is attached to the headphone bridge element connecting the respective ear pieces. The error microphones 304A and 304B are attached adjacent the respective speakers 306A and 306B to sense the reduced noise sound-wave. In this system, the outputs from the respective ANC signal processing circuits 308A and 308B are added by adders 300A and 300B to the respective left and right audio data signals, provided as a communication message or music from left and right sources 295A and 295B. The combined signal in the respective channel drives the respective headphone speaker 306A and 306B. Each ANC signal processing circuit 308A and 308B, as in the preceding examples, comprises ANC channels 120 and 140 and adder 150 of FIG. 3. The circuits 308A and 308B receives input signals from the respective reference sensor 302A or 302B and the error microphone 304A or 304B. The ANC circuits generate a noise cancelling waveform which drives a respective speaker 306A or 306B, along with the desired sound waveform from the respective source 295A or 295B. Of course, the invention may be used with a monaural headphone set, requiring only a single ANC signal processing channel.

It is understood that the above-described embodiments are merely illustrative of the possible specific embodiments which may represent principles of the present invention. For example, a noise canceller in accordance with the invention can alternatively be implemented in the frequency domain. Other arrangements may readily be devised in accordance with these principles by those skilled in the art without departing from the scope and spirit of the invention.

What is claimed is:

1. An active noise canceller system for suppressing noise over a predetermined noise bandwidth, comprising:

a noise sensor for generating a noise sensor signal indicative of said noise to be suppressed;

an error sensor for generating an error signal;

an acoustic output device for generating a cancelling acoustic signal;

a plurality of adaptive filter channels responsive to said noise sensor signal and said error signal, each channel restricted to operation over a predetermined frequency sub-band comprising said noise bandwidth and employing delay in the updating of adaptive filter weights to achieve stability in operation over said entire frequency sub-band over which said channel operates, each adaptive filter channel comprising delay means for delaying signals used in said filter weight updating by a predetermined fixed delay interval dependent on said particular frequency sub-band so as to make said entire sub-band a frequency stability region of operation of said particular adaptive filter channel, each channel producing a channel output signal for suppressing noise spectral components throughout said entire frequency sub-band, each channel further comprising bandpass filter means for filtering said noise sensor signal and said error signal so as to pass only signal frequency components within respective frequency sub-band for said channel, thereby restricting said channel to operation over said frequency sub-band, and delay means for providing a delayed version of said noise sensor signal delayed by a predetermined delay, adaptive filter weight update logic means responsive to said delayed version of said noise sensor signal for updating adaptive filter weight inputs to adaptive filter means comprising said channel, and wherein the respective delay values for the respective channels are different delay values; and means for combining said plurality of channel output signals to provide a combined signal for driving said acoustic output device to generate said cancelling acoustic signal.

2. The canceller of claim 1 wherein each said channel comprises recursive adaptive filter means.

3. The canceller of claim 1 wherein said frequency sub-bands cover said noise bandwidth.

4. An active adaptive noise canceller for suppressing noise signals from a noise source, said canceller comprising:

a noise sensor for generating noise sensor signals representative of said noise signals;

an acoustic sensor;

an acoustic output device;

a first cancellation channel coupled to said noise sensor and said acoustic sensor, said first channel comprising a first bandpass filter means for filtering said noise sensor signals, said first filter having a first pass band, a second bandpass filter means for filtering signals generated by said acoustic sensor, said second filter having said first pass band, a first delay means for delaying said first bandpass filtered noise sensor signals by a preselected first time delay, and first adaptive filter means having a plurality of inputs coupled to said first and second bandpass filter means and said first delay means, and providing a first filter output;

a second cancellation channel coupled to said noise sensor and said acoustic sensor, said second channel comprising a third bandpass filter means for filtering said noise sensor signals, said third filter having a second pass band, fourth bandpass filter means for filtering said acoustic sensor signals, said fourth filter having said second pass band, second delay means for delaying said third bandpass filtered noise sensor signals by a preselected second time delay, wherein said first time delay does not equal said second time delay, and second adaptive filter means having a plurality of inputs coupled to said second bandpass filter means, said acoustic sensor and said second delay means, and providing a second filter output; and means for combining said first and second filter outputs to provide a combined output signal, said combined output signal coupled to said acoustic output device, wherein said canceller operates to cancel noise signals emitted by said noise source within said first and second pass bands without a training mode.

5. The canceller of claim 4 wherein said first adaptive filter means comprises a plurality of first filter weights, and first weight update logic means responsive to said second bandpass filtered signals from said acoustic sensor for adjusting said first filter weights.

6. The canceller of claim 4 wherein said second adaptive filter means comprises a plurality of second filter weights, and second weight update logic means responsive to said fourth bandpass filtered signals from said acoustic sensor for adjusting said second filter weights.

7. The canceller of claim 4 wherein said first and second pass bands are substantially contiguous pass bands.

8. The canceller of claim 4 wherein said first and second filter output signals are digitized signals, and said combining means comprises a digital adder means.

9. The canceller of claim 4 wherein said first adaptive filter means comprises a recursive adaptive filter means comprising:

a first adaptive filter responsive to said first bandpass filtered noise sensor signals and comprising a plurality of first adaptive filter weight inputs, said first adaptive filter providing a first adaptive filter output;

a first weight update logic means responsive to said delayed first bandpass filtered noise sensor signals and to said second bandpass filtered acoustic sensor signals for adaptively updating said first adaptive filter weight inputs;

a second adaptive filter for providing a second adaptive filter output;

means for combining said first and second adaptive filter outputs to provide said first filter output;

said second adaptive filter responsive to said first filter output and comprising a plurality of second adaptive filter weight inputs;

third delay means for providing a delayed version of said first filter output which is delayed by a third predetermined time delay;

a second weight update logic means responsive to said delayed version of said first filter output and to said second bandpass filtered acoustic sensor signals for adaptively updating said second adaptive filter weight inputs.

10. An active noise canceller system for suppressing acoustic noise from an electric motor over a predetermined noise bandwidth, comprising:

an acoustic noise sensor disposed in proximity to said motor for generating a noise sensor signal indicative of said acoustic noise to be suppressed;

an acoustic error sensor for generating an error signal;

an acoustic output device for generating a cancelling acoustic signal;

a plurality of adaptive filter channels responsive to said noise sensor signal and said error signal, each channel restricted to operation over a predetermined frequency sub-band comprising said noise bandwidth and employing delay in the updating of adaptive filter weights to achieve stability in operation over said entire frequency sub-band over which said channel operates, each adaptive filter channel comprising delay means for delaying signals used in said filter weight updating by a predetermined fixed delay interval dependent on said particular frequency sub-band so as to make said entire sub-band a frequency stability region of operation of said particular adaptive filter channel, each channel producing a channel output signal for suppressing noise spectral components throughout said entire frequency sub-band, each channel further comprising bandpass filter means for filtering said noise sensor signal and said error signal so as to pass only signal frequency components within respective frequency sub-band for said channel, thereby restricting said channel to operation over said frequency sub-band, delay means for providing a delayed version of said noise sensor signal delayed by a predetermined delay, and adaptive filter weight update logic means responsive to said delayed version of said noise sensor signal for updating adaptive filter weight inputs to adaptive filter means comprising said channel, and wherein the respective delay values for the respective channels are different delay values; and means for combining said plurality of channel output signals to provide a combined signal for driving said acoustic output device to generate said cancelling acoustic waveform and thereby suppress acoustic noise emitted by said electric motor.

11. The canceller of claim 10 wherein each said channel comprises recursive adaptive filter means.

12. The canceller of claim 10 wherein said frequency sub-bands cover said noise bandwidth.

13. The system of claim 10 wherein said adaptive filter channels each employ an adaptive least means square algorithm to minimize said error signal without requiring a system training mode to learn transfer functions of said noise and error sensors and said acoustic output device.

14. An active noise canceller system for suppressing engine acoustic noise from a vehicle engine exhaust over a predetermined noise bandwidth, comprising:

an acoustic noise sensor disposed in proximity to said engine, for generating a noise sensor signal indicative of said noise to be suppressed;

an acoustic error sensor disposed adjacent a tailpipe of said vehicle for generating an error signal;

an acoustic output device for emitting a cancelling acoustic signal into said tailpipe;

a plurality of adaptive filter channels responsive to said noise sensor signal and said error signal, each channel restricted to operation over a predetermined frequency sub-band comprising said noise bandwidth and employing delay in the updating of adaptive filter weights to achieve stability in operation over said entire frequency sub-band over which said channel operates, each adaptive filter channel comprising delay means for delaying signals used in said filter weight updating by a predetermined fixed delay interval dependent on said particular frequency sub-band so as to make said entire sub-band a frequency stability region of operation of said particular adaptive filter channel, each channel producing a channel output signal for suppressing noise spectral components throughout said entire frequency sub-band, each channel further comprising bandpass filter means for filtering said noise sensor signal and said error signal so as to pass only signal frequency components within respective frequency sub-band for said channel, thereby restricting said channel to operation over said frequency sub-band, delay means for providing a delayed version of said noise sensor signal delayed by a predetermined delay, and adaptive filter weight update logic means responsive to said delayed version of said noise sensor signal for updating adaptive filter weight inputs to adaptive filter means comprising said channel, and wherein the respective delay values for the respective channels are different delay values; and means for combining said plurality of channel output signals to provide a combined signal for driving said acoustic output device to generate said cancelling acoustic waveform and thereby reduce engine noise.

15. The canceller of claim 14 wherein each said channel comprises recursive adaptive filter means.

16. The canceller of claim 14 wherein said frequency sub-bands cover said noise bandwidth.

17. The canceller of claim 14 wherein each acoustic output device is disposed to emit acoustic signals into said tailpipe at a location between said engine and said error sensor.

18. The system of claim 14 wherein said adaptive filter channels each employ an adaptive least means square algorithm to minimize said error signal without requiring a system training mode to learn transfer functions of said noise and error sensors and said acoustic output device.

19. An active noise canceller system for suppressing acoustic noise over a predetermined noise bandwidth incident on a headphone set having a headphone acoustic transducer, comprising:

a noise sensor disposed at an external surface of said headphone set for generating a noise sensor signal indicative of said noise to be suppressed;

an error sensor disposed for generating an error signal, said error sensor mounted adjacent said headphone acoustic transducer;

a plurality of adaptive filter channels responsive to said noise sensor signal and said error signal, each channel restricted to operation over a predetermined frequency sub-band comprising said noise bandwidth and employing delay in the updating of adaptive filter weights to achieve stability in operation over said entire frequency sub-band over which said channel operates, each adaptive filter channel comprising delay means for delaying signals used in said filter weight updating by a predetermined fixed delay interval dependent on said particular frequency sub-band so as to make said entire sub-band a frequency stability region of operation of said particular adaptive filter channel, each channel producing a channel output signal for suppressing noise spectral components throughout said entire frequency sub-band, each channel further comprising bandpass filter means for filtering said noise sensor signal and said error signal so as to pass only signal frequency components within respective frequency sub-band for said channel, thereby restricting said channel to operation over said frequency sub-band, delay means for providing a delayed version of said noise sensor signal delayed by a predetermined delay, and adaptive filter weight update logic means responsive to said delayed version of said noise sensor signal for updating adaptive filter weight inputs to adaptive filter means comprising said channel, and wherein the respective delay values for the respective channels are different delay values; and means for combining said plurality of channel output signals with an audio information signal to provide a combined signal for driving said headphone acoustic transducer to suppress said acoustic noise and enhance delivery of said audio information signal to a headphone set user.

20. The canceller of claim 19 wherein each said channel comprises recursive adaptive filter means.

21. The system of claim 19 wherein said adaptive filter channels each employ an adaptive least means square algorithm to minimize said error signal without requiring a system training mode to learn transfer functions of said noise and error sensors and said acoustic output device.

22. An active noise canceller system for suppressing acoustic noise over a predetermined noise bandwidth incident on a stereo headphone set having left and right headphone acoustic transducers, comprising:

a noise sensor disposed at an external surface of said headphone set for generating a noise sensor signal indicative of said noise to be suppressed;

left and right error sensors disposed for generating respective left and right error signals, said error sensors mounted adjacent said respective left and right headphone acoustic transducers;

a first plurality of adaptive filter channels responsive to said noise sensor signal and said left error signal, each channel of said first plurality restricted to operation over a predetermined frequency sub-band comprising said noise bandwidth and employing delay in the updating of adaptive filter weights to achieve stability in operation in said frequency sub-band over which said channel operates, each channel of said first plurality producing a channel output signal;

first means for combining said first plurality of channel output signals with a left audio information signal to provide a first combined signal for driving said left acoustic transducer;

a second plurality of adaptive filter channels responsive to said noise sensor signal and said right error signal, each channel of said second plurality restricted to operation over a predetermined frequency sub-band comprising said noise bandwidth and employing delay in the updating of adaptive filter weights to achieve stability in operation in said frequency sub-band over which said channel operates, each channel of said second plurality producing a channel output signal;

each channel further comprises bandpass filter means for filtering said noise sensor signal and said error signal so as to pass only signal frequency components within respective frequency sub-band for said channel, thereby restricting said channel to operation over said frequency sub-band, delay means for providing a delayed version of said noise sensor signal delayed by a predetermined delay, and adaptive filter weight update logic means responsive to said delayed version of said noise sensor signal for updating adaptive filter weight inputs to adaptive filter means comprising said channel, and wherein the respective delay values for the respective channels are different delay values; and second means for combining said second plurality of channel output signals with a right audio information signal to provide a second combined signal for driving said right acoustic transducer.

23. The canceller of claim 22 wherein each said channel comprises recursive adaptive filter means.

24. The canceller of claim 22 wherein said frequency sub-bands cover said noise bandwidth.

25. An active noise canceller system for suppressing acoustic noise from an engine over a predetermined noise bandwidth, comprising:

an acoustic noise sensor disposed in proximity to said engine for generating a noise sensor signal indicative of said acoustic noise to be suppressed;

an acoustic error sensor for generating an error signal;

an acoustic output device for generating a cancelling acoustic signal;

a plurality of adaptive filter channels responsive to said noise sensor signal and said error signal, each channel restricted to operation over a predetermined frequency sub-band comprising said noise bandwidth and employing delay in the updating of adaptive filter weights to achieve stability in operation over said frequency sub-band over which said channel operates, each adaptive filter channel comprising delay means for delaying signals used in said filter weight updating by a predetermined fixed delay interval dependent on said particular frequency sub-band so as to make said entire sub-band a frequency stability region of operation of said particular adaptive filter channel, each channel producing a channel output signal for suppressing noise spectral components throughout said entire frequency sub-band, each channel further comprising bandpass filter means for filtering said noise sensor signal and said error signal so as to pass only signal frequency components within respective frequency sub-band for said channel, thereby restricting said channel to operation over said frequency sub-band, delay means for providing a delayed version of said noise sensor signal delayed by a predetermined delay, and adaptive filter weight update logic means responsive to said delayed version of said noise sensor signal for updating adaptive filter weight inputs to adaptive filter means comprising said channel, and wherein the respective delay values for the respective channels are different delay values; and means for combining said plurality of channel output signals to provide a combined signal for driving said acoustic output device to generate said cancelling acoustic waveform and thereby suppress acoustic noise emitted by said engine.

26. The canceller of claim 25 wherein each said channel comprises recursive adaptive filter means.

27. The canceller of claim 25 wherein said frequency sub-bands cover said noise bandwidth.

28. The canceller of claim 25 wherein each channel further comprises delay means for providing a delayed version of said noise sensor signal delayed by a predetermined delay, adaptive filter weight update logic means responsive to said delayed version of said noise sensor signal for updating adaptive filter weight inputs to adaptive filter means comprising said channel, and wherein the respective delay values for the respective channels are different delay values.

29. The system of claim 25 wherein said adaptive filter channels each employ an adaptive least means square algorithm to minimize said error signal without requiring a system training mode to learn transfer functions of said noise and error sensors and said acoustic output device.

30. An active noise canceller system for suppressing noise over a predetermined noise bandwidth, comprising:

a noise sensor for generating a noise sensor signal indicative of said noise to be suppressed;

an error sensor for generating an error signal;

an acoustic output device for generating a cancelling acoustic signal;

a plurality of adaptive filter channels responsive to said noise sensor signal and said error signal, each channel restricted to operation over a predetermined frequency sub-band comprising said noise bandwidth and employing delay in the updating of adaptive filter weights to achieve stability in operation in said frequency sub-band over which said channel operates, each channel producing a channel output signal, and wherein said delay employed by each channel is a different delay from delays employed by each other channel;

each channel further comprising bandpass filter means for filtering said noise sensor signal and said error signal so as to pass only signal frequency components within respective frequency sub-band for said channel, thereby restricting said channel to operation over said frequency sub-band; and means for combining said plurality of channel output signals to provide a combined signal for driving said acoustic output device to generate said cancelling acoustic signal.

31. An active noise canceller system for suppressing acoustic noise from an electric motor over a predetermined noise bandwidth, comprising:

an acoustic noise sensor disposed in proximity to said motor for generating a noise sensor signal indicative of said acoustic noise to be suppressed;

an acoustic error sensor for generating an error signal;

an acoustic output device for generating a cancelling acoustic signal;

a plurality of adaptive filter channels responsive to said noise sensor signal and said error signal, each channel restricted to operation over a predetermined frequency sub-band comprising said noise bandwidth and employing delay in the updating of adaptive filter weights to achieve stability in operation in said frequency sub-band over which said channel operates, each channel producing a channel output signal, and wherein said delay employed by each channel is a different delay from delays employed by each other channel;

each channel further comprising bandpass filter means for filtering said noise sensor signal and said error signal so as to pass only signal frequency components within respective frequency sub-band for said channel, thereby restricting said channel to operation over said frequency sub-band; and means for combining said plurality of channel output signals to provide a combined signal for driving said acoustic output device to generate said cancelling acoustic waveform and thereby suppress acoustic noise emitted by said electric motor.

32. An active noise canceller system for suppressing engine acoustic noise from a vehicle engine exhaust over a predetermined noise bandwidth, comprising:

an acoustic noise sensor disposed in proximity to said engine, for generating a noise sensor signal indicative of said noise to be suppressed;

an acoustic error sensor disposed adjacent a tailpipe of said vehicle for generating an error signal;

an acoustic output device for emitting a cancelling acoustic signal into said tailpipe;

a plurality of adaptive filter channels responsive to said noise sensor signal and said error signal, each channel restricted to operation over a predetermined frequency sub-band comprising said noise bandwidth and employing delay in the updating of adaptive filter weights to achieve stability in operation in said frequency sub-band over which said channel operates, each channel producing a channel output signal, and wherein said delay employed by each channel is a different delay from delays employed by each other channel;

each channel further comprises bandpass filter means for filtering said noise sensor signal and said error signal so as to pass only signal frequency components within respective frequency sub-band for said channel, thereby restricting said channel to operation over said frequency sub-band; and means for combining said plurality of channel output signals to provide a combined signal for driving said acoustic output device to generate said cancelling acoustic waveform and thereby reduce engine noise.

33. An active noise canceller system for suppressing acoustic noise over a predetermined noise bandwidth incident on a headphone set having a headphone acoustic transducer, comprising:

a noise sensor disposed at an external surface of said headphone set for generating a noise sensor signal indicative of said noise to be suppressed;

an error sensor disposed for generating an error signal, said error sensor mounted adjacent said headphone acoustic transducer;

a plurality of adaptive filter channels responsive to said noise sensor signal and said error signal, each channel restricted to operation over a predetermined frequency sub-band comprising said noise bandwidth and employing delay in the updating of adaptive filter weights to achieve stability in operation in said frequency sub-band over which said channel operates, each channel producing a channel output signal, and wherein said delay employed by each channel is a different delay from delays employed by each other channel;

each channel further comprises bandpass filter means for filtering said noise sensor signal and said error signal so as to pass only signal frequency components within respective frequency sub-band for said channel, thereby restricting said channel to operation over said frequency sub-band; and means for combining said plurality of channel output signals with an audio information signal to provide a combined signal for driving said headphone acoustic transducer to suppress said acoustic noise and enhance delivery of said audio information signal to a headphone set user.

34. An active noise canceller system for suppressing acoustic noise over a predetermined noise bandwidth incident on a headphone set having a headphone acoustic transducer, comprising:

a noise sensor disposed at an external surface of said headphone set for generating a noise sensor signal indicative of said noise to be suppressed;

an error sensor disposed for generating an error signal, said error sensor mounted adjacent said headphone acoustic transducer;

a plurality of adaptive filter channels responsive to said noise sensor signal and said error signal, each channel restricted to operation over a predetermined frequency sub-band comprising said noise bandwidth and employing delay in the updating of adaptive filter weights to achieve stability in operation in said frequency sub-band over which said channel operates, each channel producing a channel output signal, said frequency sub-bands covering said noise bandwidth, and wherein said delay employed by each channel is a different delay from delays employed by each other channel, each channel further comprising bandpass filter means for filtering said noise sensor signal and said error signal so as to pass only signal frequency components within respective frequency sub-band for said channel, thereby restricting said channel to operation over said frequency sub-band; and means for combining said plurality of channel output signals with an audio information signal to provide a combined signal for driving said headphone acoustic transducer to suppress said acoustic noise and enhance delivery of said audio information signal to a headphone set user.

35. An active noise canceller system for suppressing acoustic noise from an engine over a predetermined noise bandwidth, comprising:

an acoustic noise sensor disposed in proximity to said engine for generating a noise sensor signal indicative of said acoustic noise to be suppressed;

an acoustic error sensor for generating an error signal;

an acoustic output device for generating a cancelling acoustic signal;

a plurality of adaptive filter channels responsive to said noise sensor signal and said error signal, each channel restricted to operation over a predetermined frequency sub-band comprising said noise bandwidth and employing delay in the updating of adaptive filter weights to achieve stability in operation in said frequency sub-band over which said channel operates, each channel producing a channel output signal; each channel further comprises bandpass filter means for filtering said noise sensor signal and said error signal so as to pass only signal frequency components within respective frequency sub-band for said channel, thereby restricting said channel to operation over said frequency sub-band, and wherein said delay employed by each channel is a different delay from delays employed by each other channel; and means for combining said plurality of channel output signals to provide a combined signal for driving said acoustic output device to generate said cancelling acoustic waveform and thereby suppress acoustic noise emitted by said engine.

36. The system of claim 1 wherein said adaptive filter channels each employ an adaptive least means square algorithm to minimize said error signal without requiring a system training mode to learn transfer functions of said noise and error sensors and said acoustic output device.

* * * * *